US011255290B2

(12) United States Patent
Hashimoto et al.

(10) Patent No.: US 11,255,290 B2
(45) Date of Patent: Feb. 22, 2022

(54) INTERNAL COMBUSTION ENGINE MANAGEMENT SYSTEM, SERVER DEVICE, AND INTERNAL COMBUSTION ENGINE MANAGEMENT METHOD

(71) Applicant: HONDA MOTOR CO., LTD., Tokyo (JP)

(72) Inventors: Manabu Hashimoto, Wako (JP); Manabu Dobashi, Wako (JP); Yusuke Ninomiya, Wako (JP); Hiroki Muta, Tokyo (JP); Hibiki Koga, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/981,306

(22) PCT Filed: Mar. 30, 2018

(86) PCT No.: PCT/JP2018/013860
§ 371 (c)(1),
(2) Date: Sep. 16, 2020

(87) PCT Pub. No.: WO2019/187098
PCT Pub. Date: Oct. 3, 2019

(65) Prior Publication Data

US 2021/0010440 A1 Jan. 14, 2021

(51) Int. Cl.
*F02D 45/00* (2006.01)
*F02D 41/40* (2006.01)
(Continued)

(52) U.S. Cl.
CPC ..... *F02D 41/402* (2013.01); *F02D 41/401* (2013.01); *F02D 41/042* (2013.01); *F02D 41/26* (2013.01); *F02D 2200/101* (2013.01)

(58) Field of Classification Search
CPC ... F02M 41/26; F02M 41/28; F02M 2041/285
See application file for complete search history.

(56) References Cited

U.S. PATENT DOCUMENTS 5,014,672 A * 5/1991 Fujii ..... F02D 41/045 123/492
9,522,669 B2 * 12/2016 Engman ..... B60L 15/2045
(Continued)

FOREIGN PATENT DOCUMENTS

JP 2003-050605 2/2003
JP 2008-019843 1/2008
(Continued)

OTHER PUBLICATIONS

International Search Report and Written Opinion for International Application No. PCT/JP2018/013860 dated May 29, 2018, 10 pages.

*Primary Examiner* — Thomas N Moulis
(74) *Attorney, Agent, or Firm* — Amin, Turocy & Watson, LLP

(57) ABSTRACT

An internal combustion engine management system includes: a plurality of internal combustion engine units of which each includes an internal combustion engine, a first communicator configured to communicate with a server device, and a communication controller configured to transmit at least estimation information out of the estimation information which is used to estimate an environment in which the internal combustion engine is placed and information of a control map which is used to control the internal combustion engine to the server device using the first communicator; and the server device that includes a second communicator configured to communicate with the first communicator, and a processor configured to extract a second internal combustion engine unit having transmitted estimation information which is similar to the estimation
(Continued)

information received from a first internal combustion engine unit out of the plurality of internal combustion engine units from the plurality of internal combustion engine units and to transmit the information of a control map received from the second internal combustion engine unit to the first internal combustion engine unit using the second communicator.

10 Claims, 7 Drawing Sheets

(51) Int. Cl.
*F02D 41/04* (2006.01)
*F02D 41/26* (2006.01)

(56) References Cited

U.S. PATENT DOCUMENTS 10,829,107 B1 * 11/2020 Lee ..... F16H 59/0204
10,990,822 B2 * 4/2021 Rogness ..... G06K 9/6288
2002/0010541 A1 * 1/2002 Houston ..... F02D 41/3005 701/115
2003/0050742 A1 3/2003 Sakamoto et al.
2006/0052909 A1 * 3/2006 Cherouny ..... B60K 31/18 701/1
2006/0085117 A1 * 4/2006 Stummer ..... B60K 28/06 701/50
2006/0227793 A1 * 10/2006 Fehr ..... F02D 41/2409 370/400
2008/0046155 A1 * 2/2008 Holthaus ..... F02D 23/005 701/51
2009/0143948 A1 * 6/2009 Dahl ..... F16H 61/662 701/56
2012/0161723 A1 * 6/2012 Wai ..... B60L 15/20 322/22
2013/0104064 A1 * 4/2013 McCormick ..... G06Q 10/0631 715/765
2013/0184966 A1 * 7/2013 Lockwood ..... F02D 41/0007 701/102
2013/0325237 A1 * 12/2013 Ikegami ..... B60L 1/003 701/22
2014/0040434 A1 * 2/2014 Rybak ..... G07C 5/008 709/219
2014/0188310 A1 * 7/2014 Hatfield ..... B25J 9/1633 701/2
2015/0224997 A1 * 8/2015 Glugla ..... F02D 41/2441 701/54
2015/0354479 A1 * 12/2015 Lindsay ..... F02D 41/009 123/480
2016/0335073 A1 * 11/2016 Hong ..... G06F 8/65
2017/0126745 A1 * 5/2017 Taylor ..... H04L 63/0227
2017/0242688 A1 * 8/2017 Yu ..... G06F 9/4411
2017/0253255 A1 * 9/2017 Crecelius ..... B61C 5/00
2018/0095745 A1 * 4/2018 Mine ..... H04L 67/34
2018/0101998 A1 * 4/2018 Pierce ..... G05D 1/0274
2018/0315256 A1 * 11/2018 Weber ..... G01C 21/3697
2018/0364711 A1 * 12/2018 Goldfain ..... G07C 5/085
2019/0232971 A1 * 8/2019 Vijayakumar ..... G07C 5/0808
2019/0313361 A1 * 10/2019 Blaha, Jr ..... H04W 64/00
2020/0332722 A1 * 10/2020 Lamberti ..... G07C 5/008
2020/0334925 A1 * 10/2020 Scheid ..... H04L 67/34
2020/0362766 A1 * 11/2020 Lamberti ..... B64D 31/06
2021/0123743 A1 * 4/2021 Mehta ..... G06Q 10/08

FOREIGN PATENT DOCUMENTS

JP 2009-235940 10/2009
JP 2015-045268 3/2015
JP 2016-107654 6/2016

* cited by examiner

124

| ID | TEMPERATURE | ATMOSPHERIC PRESSURE | ENVIRONMENT INFORMATION | MAP | EVALUATION |
|---|---|---|---|---|---|
| 001 | T1 | P1 | E1 | M01 | A |
| 002 | T1 | P1 | E1 | M02 | B |
| 003 | T1 | P1 | E1 | M03 | C |
| 004 | T2 | P1 | E2 | M04 | A |
| ⋮ | ⋮ | ⋮ | ⋮ | ⋮ | ⋮ |

124A

| ID | POSITION INFORMATION | LIMITATION INFORMATION | MAP | EVALUATION |
|---|---|---|---|---|
| 001 | (x1, y1) | L1 | M01 | A |
| 002 | (x2, y1) | L1 | M02 | B |
| 003 | (x3, y1) | L1 | M03 | C |
| 004 | (x16, y16) | L2 | M04 | A |
| ⋮ | ⋮ | ⋮ | ⋮ | ⋮ |

124B

| ID | TEMPERATURE | ATMOSPHERIC PRESSURE | ENVIRONMENT INFORMATION | POSITION INFORMATION | LIMITATION INFORMATION | MAP | EVALUATION |
|---|---|---|---|---|---|---|---|
| 001 | T1 | P1 | E1 | (x1, y1) | L1 | M01 | A |
| 002 | T1 | P1 | E1 | (x2, y1) | L1 | M02 | B |
| 003 | T1 | P1 | E1 | (x3, y1) | L1 | M03 | C |
| 004 | T2 | P1 | E2 | (x16, y16) | L2 | M04 | A |
| ⋮ | ⋮ | ⋮ | ⋮ | ⋮ | ⋮ | ⋮ | ⋮ |

10B

INTERNAL COMBUSTION ENGINE MANAGEMENT SYSTEM, SERVER DEVICE, AND INTERNAL COMBUSTION ENGINE MANAGEMENT METHOD

TECHNICAL FIELD

The invention relates to an internal combustion engine management system, a server device, and an internal combustion engine management method.

BACKGROUND ART

In the related art, techniques for a marine engine that performs control on the basis of a control map in which at least one of a rotation speed of an engine, fuel injection, intake, and exhaust is defined, that includes a storage configured to store the control map and an operation position acquirer configured to detect an operation position of the marine engine, and that acquires the control map corresponding to the operation position detected by the operation position acquirer from a control map delivery server that stores a plurality of control maps by data communication and stores the acquired control map in the storage are disclosed (for example, see Patent Literature 1).

CITATION LIST

Patent Literature

[Patent Literature 1]
Japanese Unexamined Patent Application, First Publication No. 2016-107654
[Patent Literature 2]
Japanese Unexamined Patent Application, First Publication No. 2015-45268
[Patent Literature 3]
Japanese Unexamined Patent Application, First Publication No. 2008-19843

SUMMARY OF INVENTION

Technical Problem

However, in the related art, since a control map which is delivered from the control map delivery server is a preset control map, the control map may not be optimal for an engine to be controlled.

The invention is made in consideration of the above-mentioned circumstances and an objective thereof is to provide an internal combustion engine management system, a server device, and an internal combustion engine management method that can realize control of an internal combustion engine which is more suitable for an environment.

Solution to Problem (1) An internal combustion engine management system including: a plurality of internal combustion engine units of which each includes an internal combustion engine, a first communicator configured to communicate with a server device, and a communication controller configured to transmit at least estimation information out of the estimation information which is used to estimate an environment in which the internal combustion engine is placed and information of a control map which is used to control the internal combustion engine to the server device using the first communicator; and the server device including a second communicator configured to communicate with the first communicator and a processor configured to extract a second internal combustion engine unit having transmitted estimation information which is similar to the estimation information received from a first internal combustion engine unit out of the plurality of internal combustion engine units from the plurality of internal combustion engine units and to transmit the information of a control map received from the second internal combustion engine unit to the first internal combustion engine unit using the second communicator.

(2) In the internal combustion engine management system according to (1), the estimation information may include some or all information of position information of the corresponding internal combustion engine unit, a temperature detected by a sensor provided in the internal combustion engine unit, and an atmospheric pressure detected by a sensor provided in the internal combustion engine unit.

(3) In the internal combustion engine management system according to (2), the communication controller of the internal combustion engine unit may be configured to transmit the estimation information, the information of the control map, and information indicating a control result using the control map to the server device using the first communicator, and the processor may be configured to extract an internal combustion engine unit having transmitted a control result which is evaluated as being superior to the control result received from the first internal combustion engine unit from the plurality of internal combustion engine units as the second internal combustion engine unit.

(4) In the internal combustion engine management system according to (3), the information of the control result may include information indicating an output per unit time, and the processor may be configured to extract an internal combustion engine unit having transmitted information of a control result in which the information indicating the output per unit time is superior to that in the first internal combustion engine unit as the second internal combustion engine unit having transmitted the control result evaluated as being superior.

(5) In the internal combustion engine management system according to (4), the information of the control result may include an output per unit time and a control value of an air-fuel ratio, and the processor may be configured to transmit the information of a control map including the control value of the air-fuel ratio received from the second internal combustion engine unit to the first internal combustion engine unit using the second communicator.

(6) In the internal combustion engine management system according to (1), the control map may include at least an upper limit value of a rotation speed of the internal combustion engine, and the processor may be configured to transmit the information of a control map including the upper limit value received from the second internal combustion engine unit to the first internal combustion engine unit using the second communicator.

(7) A server device comprising: a second communicator configured to communicate with a first communicator; and a processor configured to extract a second internal combustion engine unit having transmitted estimation information which is similar to estimation information received from a first internal combustion engine unit out of a plurality of internal combustion engine units, and to transmit information of a control map received from the second internal combustion engine unit to the first internal combustion engine unit using the second communicator, each of the plurality of internal combustion engine units including an internal combustion engine, the first communicator configured to communicate with the server device, and a communication controller configured to transmit at least the estimation information out of the estimation information which is used to estimate an environment in which the internal combustion engine is placed and the information of a control map which is used to control the internal combustion engine to the server device using the first communicator.

(8) An internal combustion engine management method including: causing a computer of an internal combustion engine unit to transmit at least estimation information out of the estimation information which is used to estimate an environment in which an internal combustion engine is placed and information of a control map which is used to control the internal combustion engine to a server device using a first communicator configured to communicate with the server device; and causing a computer of the server device to extract a second internal combustion engine unit having transmitted estimation information which is similar to the estimation information received from a first internal combustion engine unit out of the plurality of internal combustion engine units from the plurality of internal combustion engine units and to transmit the information of a control map received from the second internal combustion engine unit to the first internal combustion engine unit using a second communicator configured to communicate with the first communicator.

Advantageous Effects of Invention

According to the aspects (1) to (8), it is possible to realize control of an internal combustion engine which is more suitable for an environment.

DESCRIPTION OF EMBODIMENTS

Hereinafter, an internal combustion engine management system, a server device, an internal combustion engine unit, and an internal combustion engine management method according to embodiments of the invention will be described with reference to the accompanying drawings.

First Embodiment

[Entire Configuration]

Figure 1:
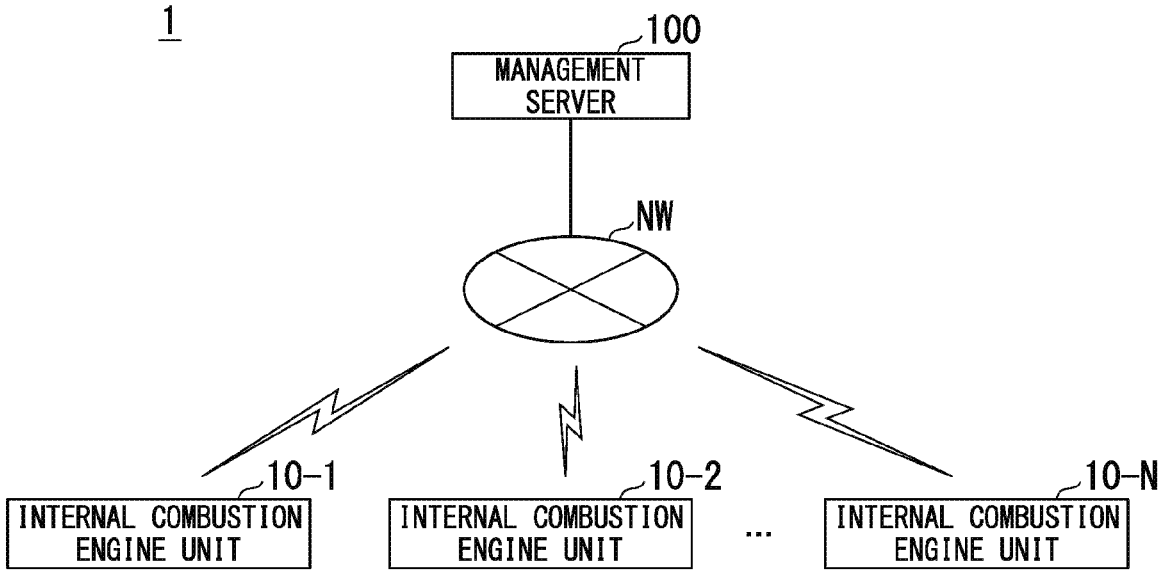
FIG. 1 is a diagram showing a configuration of an internal combustion engine management system 1 according to a first embodiment.

FIG. 1 is a diagram showing a configuration of an internal combustion engine management system 1 according to a first embodiment. The internal combustion engine management system 1 includes, for example, internal combustion engine units 10-1 to 10-N (where "N" is an arbitrary natural number) and a management server 100. In the following description, the internal combustion engine units 10-1 to 10-N are simply referred to as "internal combustion engine units 10" when they are not distinguished.

The internal combustion engine units 10 and the management server 100 communicate with each other via a network NW. The network NW includes, for example, a wide area network (WAN), a local area network (LAN), the Internet, a dedicated communication line, a radio base station, and a provider.

[Internal Combustion Engine Unit]

In this embodiment, each internal combustion engine unit 10 is described, for example, as being used for various applications (a so-called general-purpose engine) and may be mounted on a vehicle or the like.

Figure 2:
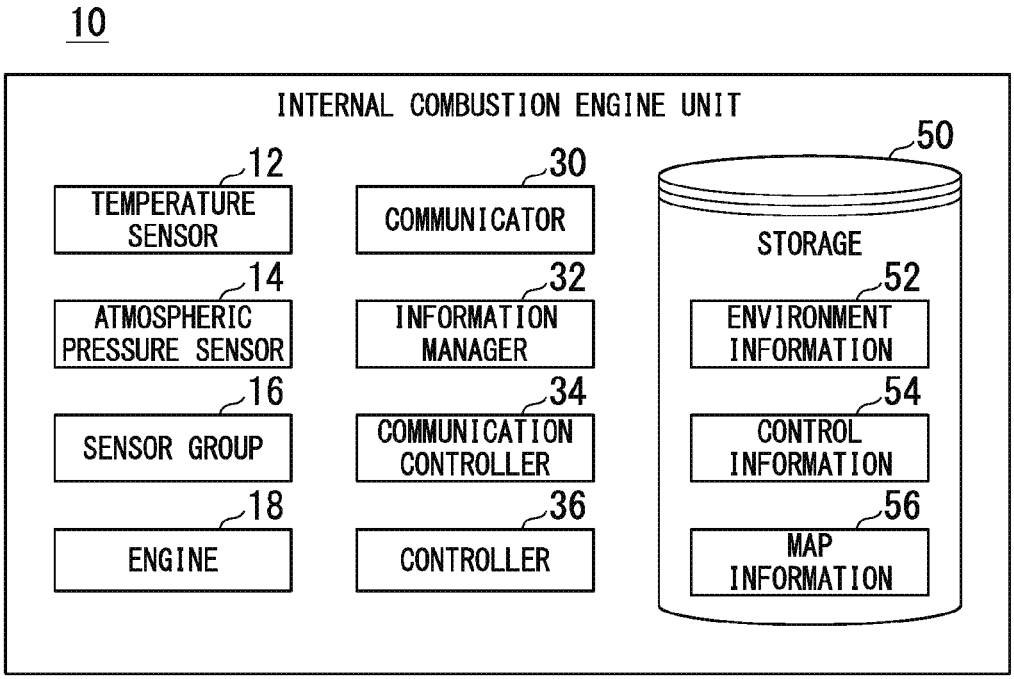
FIG. 2 is a diagram showing an example of a functional configuration of an internal combustion engine unit 10.

FIG. 2 is a diagram showing an example of a functional configuration of an internal combustion engine unit 10. The internal combustion engine unit 10 includes, for example, a temperature sensor 12, an atmospheric pressure sensor 14, a sensor group 16, an engine 18, a communicator 30, an information manager 32, a communication controller 34, a controller 36, and a storage 50.

The information manager 32, the communication controller 34, and the controller 36 are embodied, for example, by causing a processor such as a central processor (CPU) to execute a program (software). Some of all of such elements may be embodied in hardware (including circuitry) such as a large scale integration (LSI) circuit, an application specific integrated circuit (ASIC), a field-programmable gate array (FPGA), or a graphics processor (GPU) or may be embodied in cooperation of software and hardware. The program may be stored in the storage 50 of the internal combustion engine unit 10 in advance or may be stored in a removable storage medium such as a DVD or a CD-ROM and installed in the storage 50 by setting the storage medium to a drive device).

The storage 50 is embodied, for example, by an HDD, a flash memory, an electrically erasable programmable read only memory (EEPROM), a read only memory (ROM), or a random access memory (RAM).

The temperature sensor 12 is a sensor that detects a temperature of an environment in which the internal combustion engine unit 10 is placed. The atmospheric pressure sensor 14 is a sensor that detects an atmospheric pressure of the environment in which the internal combustion engine unit 10 is placed.

The sensor group 16 includes a rotation speed sensor, an intake air pressure sensor, a fuel injection pressure sensor, a throttle opening sensor, a torque sensor, a temperature sensor that detects a temperature of the engine 18, and a fuel gauge. The rotation speed sensor detects, for example, a rotation speed of an engine. The intake air pressure sensor detects a pressure of intake air sucked into a combustion chamber of the engine 18 from the outside. The fuel injection pressure sensor detects a pressure of fuel which is injected by an injector. The throttle opening sensor detects an opening of a throttle valve. The internal combustion engine unit 10 includes, for example, an element such as an injector (not shown) that injects fuel such as gasoline in addition to the above-mentioned functional configuration.

The communicator 30 communicates with the management server 100.

The information manager 32 stores a result of detection from the temperature sensor 12, a result of detection from the atmospheric pressure sensor 14, a result of detection from the sensor group 16, an operation state of the engine 18, and the like in the storage 50.

The communication controller 34 transmits estimation information which is used to estimate an environment in which the host unit is placed to the management server 100 via the communicator 30. The estimation information is information of one or more of the position information of the internal combustion engine unit 10, the temperature detected by the temperature sensor 12, and the atmospheric pressure detected by the atmospheric pressure sensor 14. The communication controller 34 transmits the estimation information which is used to estimate the environment in which the host unit is placed and information of a control map which is used to control the engine 18 to the management server 100 using the communicator 30.

The controller 36 controls the engine 18 on the basis of map information 56 which is stored in the storage 50 in advance or map information which is transmitted by the management server 100. A control map in the map information includes information of various parameters such as the rotation speed of the engine 18 which is used to drive the engine 18, the time at which fuel is injected into a cylinder, an amount of fuel injected, and air-fuel ratio when the engine 18 operates.

The storage 50 stores, for example, environment information 52, control information 54, and map information 56.

The environment information 52 includes a result of detection from the temperature sensor 12 and a result of detection from the atmospheric pressure sensor 14 which are acquired at predetermined intervals. The control information 54 includes information indicating a state of the engine 18 when the engine 18 is made to operate and information indicating a control map which is used at that time. The control information 54 includes, for example, the result of detection from the sensor group 16 and a control value which is given when the engine 18 is made to operate. The control information 54 includes, for example, information which is used to determine whether a control map used in a predetermined environment in which the engine 18 is placed is useful in comparison with another control map used in the same predetermined environment. The map information 56 is information of a preset control map or a control map transmitted from the management server 100.

[Management Server]

Figures 3, 4:
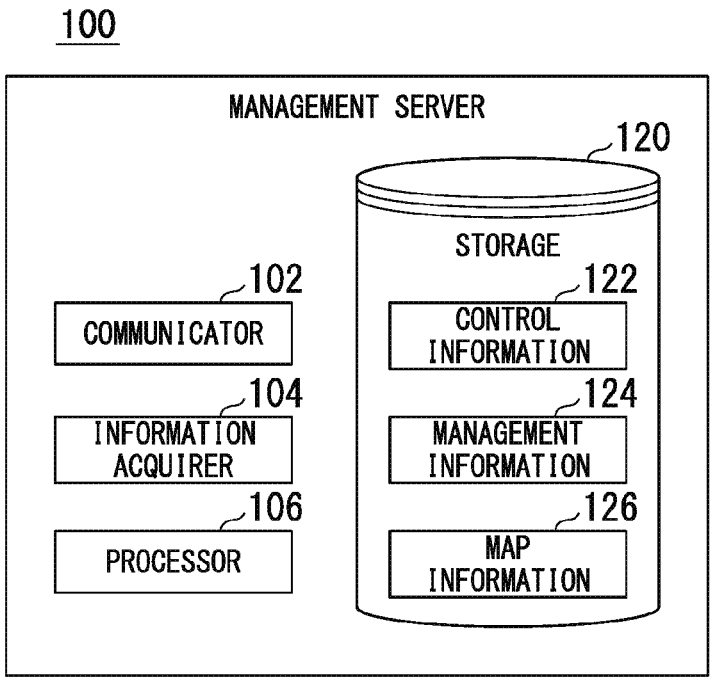
FIG. 3 is a diagram showing an example of a functional configuration of a management server 100.
FIG. 4 is a diagram showing an example of details of management information 124.

FIG. 3 is a diagram showing an example of a functional configuration of the management server 100. The management server 100 includes, for example, a communicator 102, an information acquirer 104, a processor 106, and a storage 120. The information acquirer 104 and the processor 106 are embodied, for example, by causing a processor such as a CPU to execute a program (software). Some of all of such elements may be embodied in hardware (including circuitry) such as an LSI circuit, an ASIC, an FPGA, or a GPU or may be embodied in cooperation of software and hardware. The program may be stored in the storage 120 of the management server 100 in advance or may be stored in a removable storage medium such as a DVD or a CD-ROM and installed in the storage 120 by setting the storage medium to a drive device). The storage 120 is embodied, for example, by an HDD, a flash memory, an EEPROM, a ROM, or a RAM.

The communicator 102 communicates with the internal combustion engine units 10.

The information acquirer 104 acquires information which is transmitted by the internal combustion engine units 10. The processor 106 extracts a second internal combustion engine unit having transmitted estimation information which is similar to the estimation information received from a first internal combustion engine unit out of a plurality of internal combustion engine units 10 from the plurality of internal combustion engine units, and transmits information of a control map received from the second internal combustion engine unit to the first internal combustion engine unit using the communicator 102. The processor 106 acquires the estimation information, the information of control maps, and information indicating control results using the control maps from the internal combustion engine units 10 and extracts an internal combustion engine unit having transmitted a control result which is evaluated as being superior to the control result received from the first internal combustion engine unit as the second internal combustion engine unit from the plurality of internal combustion engine units.

The storage 120 stores, for example, control information 122, management information 124, and map information 126 in addition to a program which is read and executed by a processor. The control information 122 is the control information 54 which is transmitted from the internal combustion engine units 10.

FIG. 4 is a diagram showing an example of details of the management information 124. The management information 124 is information obtained by processing information which is acquired from a plurality of internal combustion engine units 10. The management information 124 is information in which identification information of each internal combustion engine unit 10 is correlated with a result of detection from the temperature sensor 12 of the internal combustion engine unit 10, a result of detection from the atmospheric pressure sensor 14 of the internal combustion engine unit 10, environment information indicating an environment in which the internal combustion engine unit 10 is placed, information of a control map used by the internal combustion engine unit 10, and evaluation. The environment information is information indicating a type of an environment into which an environment is classified depending on a combination of a prescribed temperature and an atmospheric pressure. Information of combinations of temperature and atmospheric pressure which are classified into the same type of environment is similar environment information (estimation information).

For example, the control information 54 is used for the evaluation. For example, the evaluation is performed on the basis of a combination of a result of detection from the sensor group 16 acquired when the engine 18 of the internal combustion engine unit 10 operates and a control map used for operation of the engine 18 and an evaluation criterion which is set for the combination. For example, the processor 106 derives a score on the basis of the control information 54 and the evaluation criterion and gives an evaluation index to the control map on the basis of the derived score. The evaluation criterion is, for example, a criterion that an output value of the engine 18 (a rotation speed or a torque) is within a predetermined range with respect to a result of detection from the fuel injection pressure sensor or a fuel injection time or a criterion that an amount of fuel consumed is equal to or less than a predetermined amount with respect to change of the output value of the engine 18. For example, when the types of the environment information are the same, the evaluation for the control map becomes superior as output performance of the engine 18 per unit time becomes better, fuel efficiency becomes higher, or the engine 18 operates more efficiently. The processor 106 may relatively evaluate the control information 54 of the internal combustion engine units 10 with the same type of environment.

[(First) Process of Internal Combustion Engine Unit]

Figure 5:
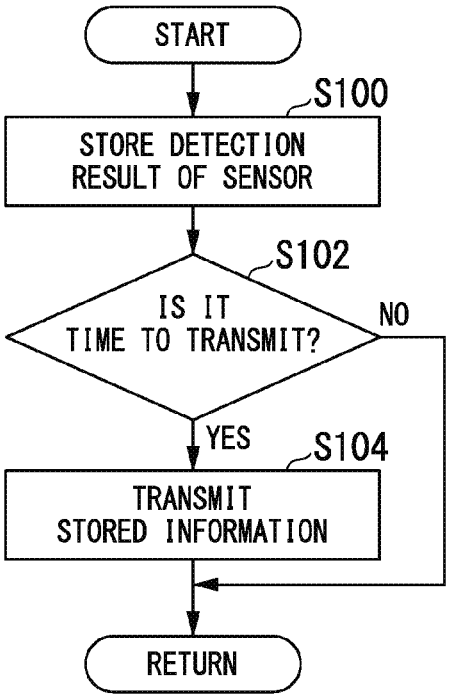
FIG. 5 is a flowchart showing an example of a flow of processes which are performed by the internal combustion engine unit 10.

FIG. 5 is a flowchart showing an example of a flow of processes which are performed by the internal combustion engine unit 10. First, the information manager 32 acquires detection results of the temperature sensor 12, the atmospheric pressure sensor 14, and the sensor group 16 and stores the acquired information in the storage 50 (Step S100). Then, the communication controller 34 determines whether it is time to transmit information stored in Step S100 to the management server 100 (Step S102).

When it is not time to transmit the information stored in Step S100 to the management server 100, the processes of one routine in the flowchart end. Then, the process flow returns to Step S100.

When it is time to transmit the information stored in Step S100 to the management server 100, the communication controller 34 transmits the information stored in Step S100 to the management server 100 (Step S104). Accordingly, the processes of one routine in the flowchart end.

Through the above-mentioned processes, information transmitted from the internal combustion engine units 10 is acquired by the management server 100 and the acquired information is stored in the storage 120 of the management server 100. The processor 106 of the management server 100 processes the acquired information and generates the management information 124 shown in FIG. 4.

[Processes of Management Server]

Figure 6:
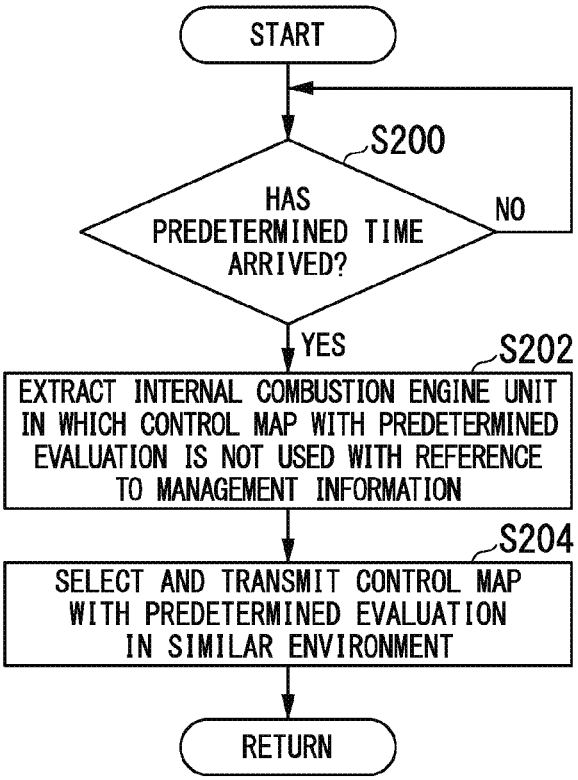
FIG. 6 is a flowchart showing an example of a flow of processes which are performed by the management server 100.

FIG. 6 is a flowchart showing an example of a flow of processes which are performed by the management server 100. First, the processor 106 determines whether a predetermined time has arrived (Step S200). When the predetermined time has arrived, the processor 106 extracts an internal combustion engine unit 10 in which a control map with predetermined evaluation is not used with reference to the management information 124 (Step S202).

Then, the processor 106 selects a control map with predetermined evaluation in a similar environment which is applied to the extracted internal combustion engine unit 10, and transmits the selected control map to the extracted internal combustion engine unit 10 (Step S204). Specifically, the processor 106 compares information and evaluation of a control map which is used for control of the first internal combustion engine unit 10 with information and evaluation of a control map which is used for control of the second internal combustion engine unit 10, and transmits information of the control map which is used for control of the second internal combustion engine unit to the first internal combustion engine unit 10 when it is determined that the control map which is used for control of the second internal combustion engine unit 10 is evaluated as being superior to the control map which is used for control of the first internal combustion engine unit in similar environments. Accordingly, the processes of one routine in the flowchart end.

Through the above-mentioned processes, for example, the processor 106 can provide a control map capable of improving operation efficiency of the internal combustion engine unit 10 to the internal combustion engine unit 10. For example, in the example shown in FIG. 4, information of a control map "M01" with predetermined evaluation which is used for "ID001" is transmitted to the internal combustion engine units 10 with ID002 and ID003 in which the control map with predetermined evaluation is not used. In this way, the management server 100 can provide a control map which is more suitable for an environment to the internal combustion engine unit 10.

[(Second) Process of Internal Combustion Engine Unit]

Figure 7:
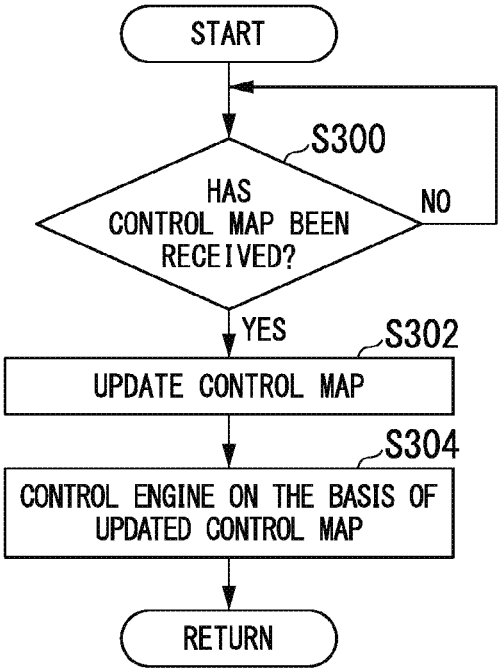
FIG. 7 is a flowchart showing an example of a flow of processes which are performed by the internal combustion engine unit 10.

FIG. 7 is a flowchart showing an example of a flow of processes which are performed by the internal combustion engine unit 10. This process is a process which is performed by an internal combustion engine unit 10 in which the control map with predetermined evaluation is not used in the flowchart shown in FIG. 6.

First, the information manager 32 determines whether a control map to be updated has been received from the management server 100 (Step S300). When a control map to be updated has been received, the information manager 32 updates the control map (Step S302). Then, the controller 36 controls the engine 18 on the basis of the updated control map (Step S306). Accordingly, the processes of one routine in the flowchart end. As described above, the internal combustion engine units 10 can realize control of the engine 18 which is more suitable for an environment.

Figure 8:
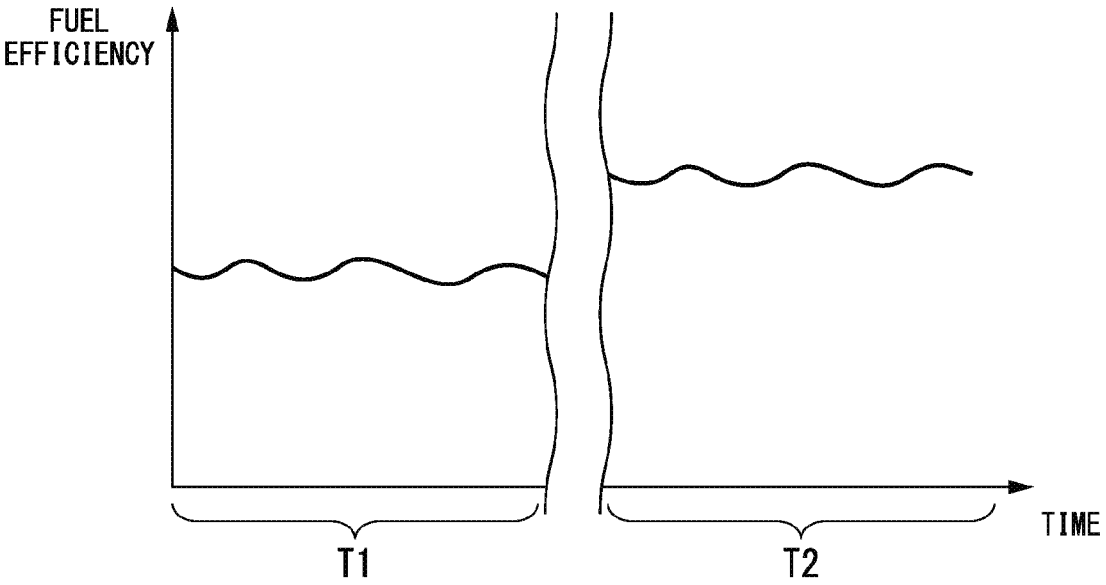
FIG. 8 is a diagram showing an example of operation results of an engine 18 based on a non-changed control map and a changed control map.

FIG. 8 is a diagram showing an example of operation results of the engine 18 based on a non-changed control map and a changed control map. FIG. 8 shows change of fuel efficiency with respect to the operation state of the engine 18. The vertical axis in FIG. 8 represents fuel efficiency, and the horizontal axis in FIG. 8 represents time. A time T1 in FIG. 8 indicates a control result based on a non-changed control map and a time T2 in FIG. 8 indicates a control result based on a changed control map. The internal combustion engine unit 10 updates the control map with the control map transmitted from the management server 100 and uses the updated control map, for example, whereby fuel efficiency or output performance of the engine 18 is improved.

According to the above first embodiment, the management server 100 extracts a second internal combustion engine unit having transmitted environment information similar to environment information which is a combination of temperature and atmospheric pressure which is transmitted from a first internal combustion engine unit out of a plurality of internal combustion engine units 10 and transmits information of a control map received from the extracted second internal combustion engine unit to the first internal combustion engine unit using the communicator 102, whereby it is possible to provide a control map capable of realizing control of an internal combustion engine suitable for an environment to the internal combustion engine unit 10.

Second Embodiment

A second embodiment will be described below. A management server 100 according to the second embodiment updates control maps using position information of an internal combustion engine unit 10A. In the following description, differences from the first embodiment will be mainly described.

Figures 9, 10:
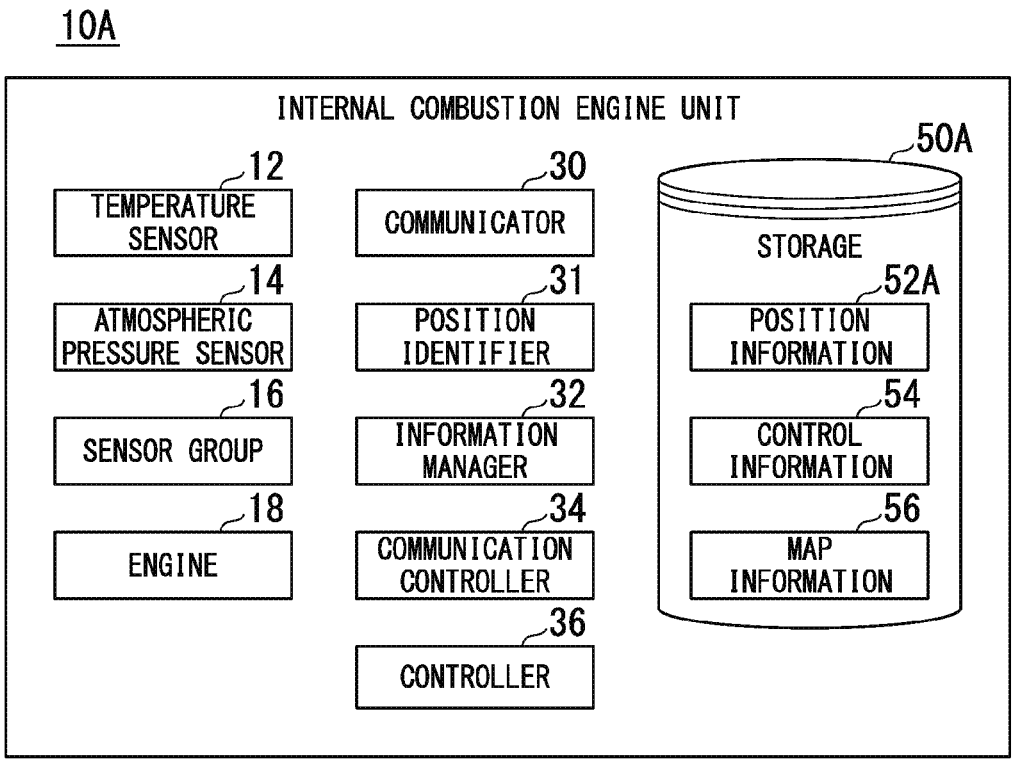
FIG. 9 is a diagram showing an example of a functional configuration of an internal combustion engine unit 10A according to a second embodiment.
FIG. 10 is a diagram showing an example of details of management information 124A.

FIG. 9 is a diagram showing an example of a functional configuration of an internal combustion engine unit 10A according to the second embodiment. The internal combustion engine unit 10A according to the second embodiment includes a position identifier 31 in addition to the functional configuration of the internal combustion engine unit 10 according to the first embodiment. In the internal combustion engine unit 10A, one or both of the temperature sensor 12 and the atmospheric pressure sensor 14 may be omitted.

The position identifier 31 identifies its own position, for example, on the basis of radio waves received from GNSS satellites (for example, GPS satellites).

The internal combustion engine unit 10A according to the second embodiment includes a storage 50A instead of the storage 50 in the functional configuration of the internal combustion engine unit 10 according to the first embodiment. Position information 52A is stored in the storage 50A. Position information 52A is a history of position information which is identified by the position identifier 31.

[(Third) Process of Internal Combustion Engine Unit]

First, the information manager 32 stores position information identified by the position identifier 31 in the storage 50A. Then, the communication controller 34 determines whether it is time to transmit the position information and the control information 54 stored in the storage 50A to the management server 100. When it is time to transmit the information stored in the storage 50A to the management server 100, the communication controller 34 transmits the stored information to the management server 100.

[Processes of Management Server]

The processor 106 determines whether a predetermined time has arrived. When the predetermined time has arrived, the processor 106 extracts an internal combustion engine unit 10 in which a control map with predetermined evaluation is not used with reference to management information 124A. Then, the processor 106 selects a control map with predetermined evaluation which is applied to the extracted internal combustion engine unit 10 and transmits the selected control map to the extracted internal combustion engine unit 10.

FIG. 10 is a diagram showing an example of details of the management information 124A. The management information 124A is information obtained by processing information acquired from a plurality of internal combustion engine units 10A. The management information 124A is information in which identification information of each internal combustion engine unit 10A is correlated with position information of internal combustion engine unit 10, limitation information indicating limitation in an environment in which the internal combustion engine unit 10A is placed, information of a control map which is used by the internal combustion engine unit 10A, and evaluation thereof. The limitation information indicating limitation in an environment in which an internal combustion engine unit 10A is placed is information indicating environmental regulation (for example, a maximum amount of exhaust gas per unit time) which is prescribed for each region, regulation of a type of fuel which is used, regulation of noise (for example, regulation of a rotation speed), or the like. For example, the same limitation is given to position information which is included in a predetermined region. Position information to which the same limitation information is given is similar position information (estimation information).

Regarding the evaluation, evaluation of a control map becomes superior, for example, as the engine 18 is operating more efficiently with a range of limitation in an environment.

[(Fourth) Process of Internal Combustion Engine Unit]

When the information manager 32 receives a control map to be updated from the management server 100, the information manager 32 updates the control map. Then, the controller 36 controls the engine 18 on the basis of the updated control map. Accordingly, the internal combustion engine unit 10A can realize control of the engine 18 which is more suitable for an environment.

According to the above second embodiment, the management server 100 extracts a second internal combustion engine unit having transmitted position information which is similar to position information transmitted from a first internal combustion engine unit out of a plurality of internal combustion engine units 10 and transmits information of a control map received from the extracted second internal combustion engine unit to the first internal combustion engine unit using the communicator 102, whereby the same advantages effects as in the first embodiment can be achieved.

Third Embodiment

A third embodiment will be described below. A management server 100 according to the third embodiment updates control maps using a detection result of the temperature sensor 12, a detection result of the atmospheric pressure sensor 14, and position information of an internal combustion engine unit 10B. In the following description, differences from the second embodiment will be mainly described.

[Processes of Internal Combustion Engine Unit]

The communication controller 34 transmits the result of detection from the temperature sensor 12, the result of detection from the atmospheric pressure sensor 14, and the position information identified by the position identifier 31 to the management server 100.

[Processes of Management Server]

The processor 106 generates management information 124B by processing information transmitted from the internal combustion engine units 10A. The processor 106 extracts an internal combustion engine unit 10A in which a control map with predetermined evaluation is not used with reference to the management information 124B. Then, the processor 106 selects a control map with predetermined evaluation which is applied to the extracted internal combustion engine unit 10 and transmits the selected control map to the extracted internal combustion engine unit 10.

Figures 11, 12:
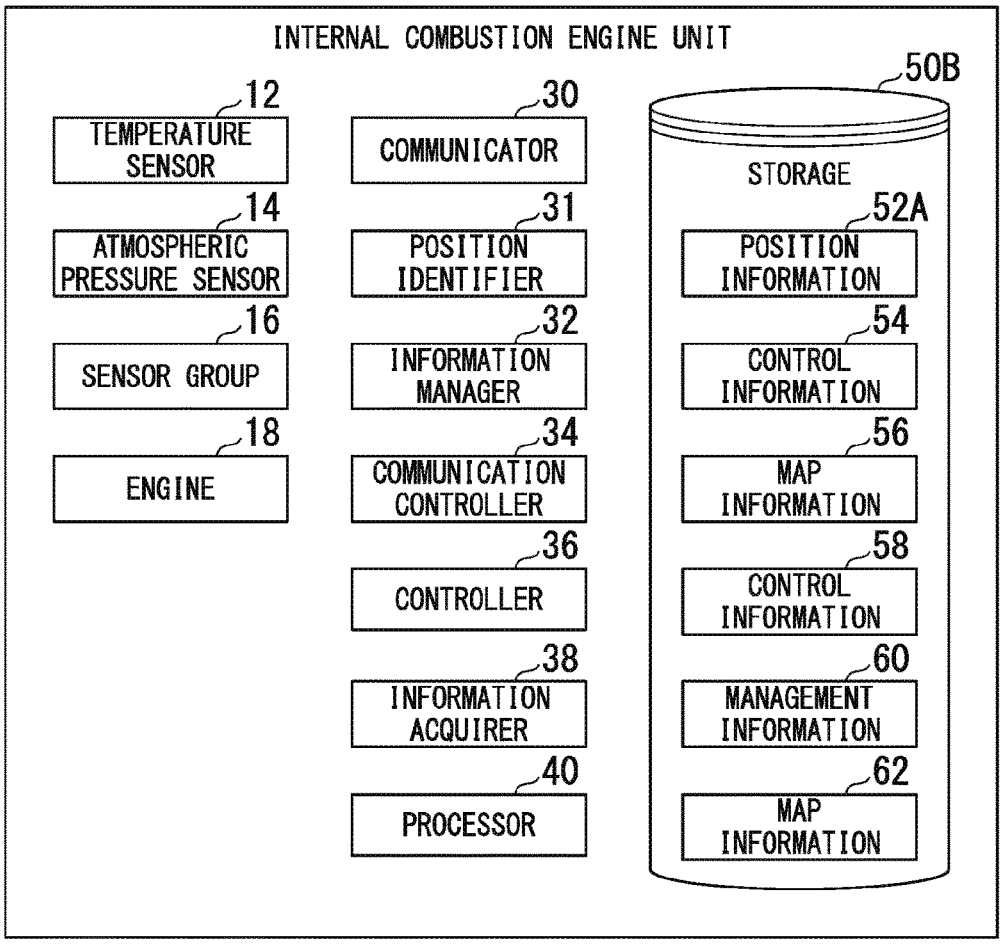
FIG. 11 is a diagram showing an example of details of management information 124B.
FIG. 12 is a diagram showing an example of a functional configuration of an internal combustion engine unit 10B.

FIG. 11 is a diagram showing an example of details of the management information 124B. The management information 124B is information obtained by processing information acquired from a plurality of internal combustion engine units 10A. The management information 124A is information in which identification information of each internal combustion engine unit 10 is correlated with a result of detection from the temperature sensor 12 of the internal combustion engine unit 10, a result of detection from the atmospheric pressure sensor 14 of the internal combustion engine unit 10, environment information indicating an environment in which the internal combustion engine unit 10 is placed, position information of the internal combustion engine unit 10A, limitation information indicating limitation in the environment in which the internal combustion engine unit 10A is placed, and information of a control map which is used by the internal combustion engine unit 10A, and evaluation thereof.

For example, in control maps of the internal combustion engine units 10 in which environment information in which the internal combustion engine units 10 are placed and types of limitation in the environments are the same, for example, evaluation for a control map which is used for more efficient operation of the engine 18 becomes superior.

When a control map to be updated is received from the management server 100, the information manager 32 updates the control map and controls the engine 18 on the basis of the updated control map. Accordingly, the internal combustion engine unit 10A can realize control of the engine 18 which is more suitable for an environment.

According to the above third embodiment, it is possible to more accurately provide a control map capable of realizing control of an internal combustion engine suitable for an environment to an internal combustion engine unit 10 by using environment information and position information.

[Others]

The same functions as the functions provided in the management server 100 may be included in the internal combustion engine unit 10B. FIG. 12 is a diagram showing an example of a functional configuration of the internal combustion engine unit 10B. The internal combustion engine unit 10B includes, for example, an information acquirer 38, a processor 40, and a storage 50B in addition to the functional configuration of the internal combustion engine unit 10A. The information acquirer 38 and the processor 40 have the same functions as the information acquirer 104 and the processor 106 of the management server 100. The storage 50B stores control information 58, management information 60, and map information 62 in addition to information which is stored in the storage 50A. The control information 58, the management information 60, and the map information 62 are the same information as the control information 122, the management information 124, and the map information 126 stored in the storage 120 of the management server 100.

According to the above embodiments, an internal combustion engine management system (1) includes: a plurality of internal combustion engine units (10) of which each includes an internal combustion engine (18), a first communicator (30) configured to communicate with a server device (100), and a communication controller (34) configured to transmit at least estimation information out of the estimation information which is used to estimate an environment in which the internal combustion engine is placed and information of a control map which is used to control the internal combustion engine to the server device using the first communicator; and the server device that includes a second communicator (102) configured to communicate with the first communicator, and a processor (106) configured to extract a second internal combustion engine unit having transmitted estimation information which is similar to the estimation information received from a first internal combustion engine unit out of the plurality of internal combustion engine units from the plurality of internal combustion engine units and to transmit the information of a control map received from the second internal combustion engine unit to the first internal combustion engine unit using the second communicator, whereby it is possible to realize control of an internal combustion engine which is more suitable for an environment.

Hardware Configuration

Figure 13:
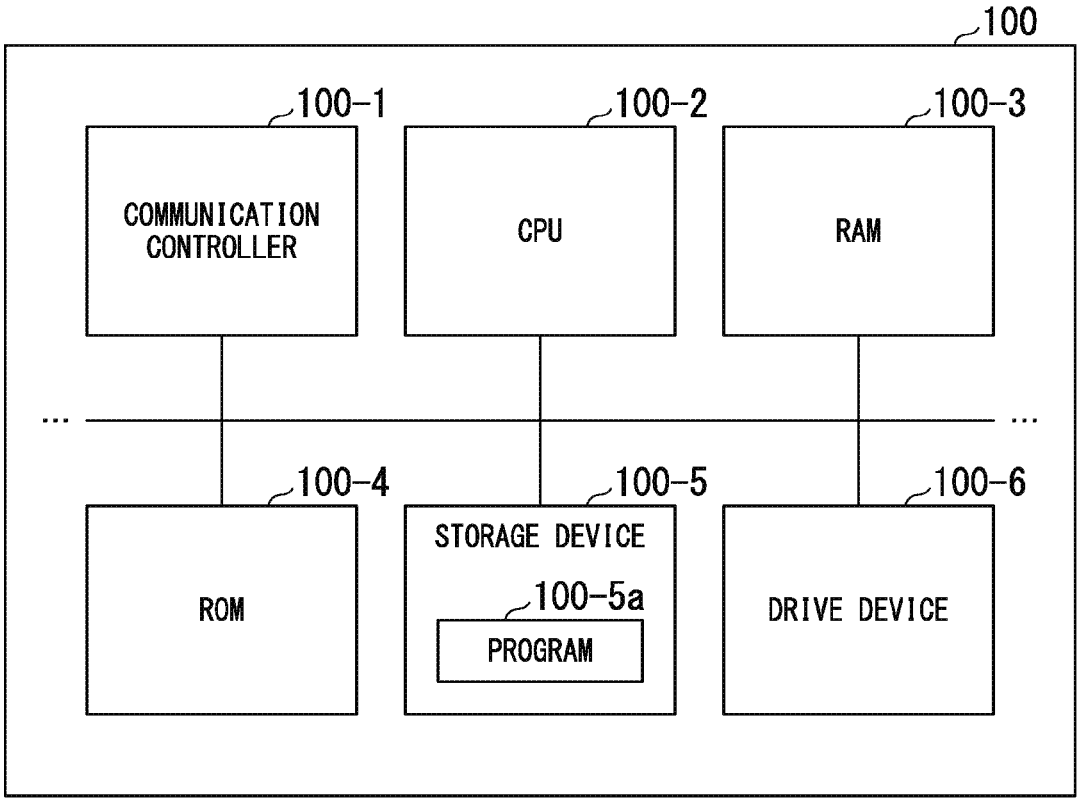
FIG. 13 is a diagram showing an example of a hardware configuration of the internal combustion engine unit 10 or the management server 100 according to the embodiments.

FIG. 13 is a diagram showing an example of a hardware configuration of the internal combustion engine unit 10 or the management server 100 according to the embodiments. As shown in the drawing, the management server 100 has a configuration in which a communication controller 100-1, a CPU 100-2, a random access memory (RAM) 100-3 that is used as a work memory, a read only memory (ROM) 100-4 that stores a booting program or the like, a storage device 100-5 such as a flash memory or a hard disk drive (HDD), a drive device 100-6, and the like are connected to each other via an internal bus or a dedicated communication line. The communication controller 100-1 communicates with elements other than the management server 100. A program 100-5*a* which is executed by the CPU 100-2 is stored in the storage device 100-5. This program is loaded into the RAM 100-3 by a direct memory access (DMA) controller (not shown) or the like and is executed by the CPU 100-2. Accordingly, some or all of the information acquirer 104 and the processor 106 are embodied. Similarly, the internal combustion engine unit 10 may also include the communication controller 100-1, the CPU 100-2, the RAM 100-3, the ROM 100-4, the storage device 100-5, and the drive device 100-6 which are shown in FIG. 13. Some or all of the information manager 32, the communication controller 34, and the controller 36 are embodied.

The above embodiments may be described as follows:

A server device including a storage device in which a program is stored and a hardware processor, the hardware processor being configured to perform: by executing the program stored in the storage device, extract a second internal combustion engine unit having transmitted estimation information which is used to estimate an environment in which an internal combustion engine is placed and which is similar to the estimation information received from a first internal combustion engine unit out of a plurality of internal combustion engine units, each of which includes a communication controller configured to transmit at least the estimation information out of the estimation information and information of a control map which is used to control the internal combustion engine to the server device using a first communicator configured to communicate with the server device, from the plurality of internal combustion engines; and transmit the information of a control map received from the second internal combustion engine unit to the first internal combustion engine unit using a second communicator configured to communicate with the first communicator.

While embodiments of the invention have been described above using examples, the invention is not limited to the embodiments and can be subjected to various modifications and replacements without departing from the gist of the invention.

REFERENCE SIGNS LIST

1 Management system
10 Internal combustion engine unit
12 Temperature sensor
14 Atmospheric pressure sensor
16 Sensor group
18 Engine
30 Communicator
32 Information manager
34 Communication controller
36 Controller
50 Storage
100 Management server
102 Communicator
104 Information acquirer
106 Processor
120 Storage

The invention claimed is:

1. An internal combustion engine management system comprising:

a plurality of internal combustion engine units of which each includes an internal combustion engine, a first communicator configured to communicate with a server device, and a communication controller configured to transmit estimation information which is used to estimate an environment in which the internal combustion engine is placed, information of a control map which is used to control the internal combustion engine and information indicating a control result using the control map to the server device using the first communicator; and the server device including a second communicator configured to communicate with the first communicator, and a processor configured to transmit information to the plurality of internal combustion engine units using the second communicator, wherein, the processor:

acquires identification information of the plurality of internal combustion engine units, identification information, the estimation information, the information of a control map, and the information indicating a control result using the control map is transmitted by each of the plurality of internal combustion engine units;

evaluates the control map that is transmitted by each of the plurality of internal combustion engine units, based on the information indicating a control result using the control map that is transmitted by each of the plurality of internal combustion engine units and evaluation criteria;

extracts a first internal combustion engine unit in which evaluation is not satisfied from among the plurality of internal combustion engine units; and transmits a control map that is used by a second internal combustion engine unit to the first internal combustion engine unit, the second internal combustion engine unit is different from the first internal combustion engine unit and is included in the plurality of internal combustion engine units;

the second internal combustion engine unit is an internal combustion engine unit that transmitted the control map in which evaluation is satisfied and the second internal combustion engine unit having transmitted estimation information which is similar to the estimation information received from the first internal combustion engine unit, and the first internal combustion engine unit controls the internal combustion engine using the control map that is used by a second internal combustion engine unit.

2. The internal combustion engine management system according to claim 1, wherein the estimation information includes some or all information of position information of a corresponding internal combustion engine unit of the plurality of internal combustion engine units, a temperature detected by a sensor provided in the internal combustion engine unit, and an atmospheric pressure detected by a sensor provided in the internal combustion engine unit.

3. The internal combustion engine management system according to claim 2, wherein the communication controller of the internal combustion engine unit is configured to transmit the estimation information, the information of the control map, and information indicating a control result using the control map to the server device using the first communicator, and wherein the processor is configured to extract an internal combustion engine unit having transmitted a control result which is evaluated as being superior to the control result received from the first internal combustion engine unit from the plurality of internal combustion engine units as the second internal combustion engine unit.

4. The internal combustion engine management system according to claim 3, wherein the information of the control result includes information indicating an output per unit time, and wherein the processor is configured to extract an internal combustion engine unit having transmitted information of a control result in which the information indicating the output per unit time is superior to that in the first internal combustion engine unit as the second internal combustion engine unit having transmitted the control result evaluated as being superior.

5. The internal combustion engine management system according to claim 4, wherein the control map includes an output per unit time and a control value of an air-fuel ratio, and wherein the processor is configured to transmit the information of a control map including the control value of the air-fuel ratio received from the second internal combustion engine unit to the first internal combustion engine unit using the second communicator.

6. The internal combustion engine management system according to claim 1, wherein the information of the control result includes at least an upper limit value of a rotation speed of the internal combustion engine, and wherein the processor is configured to transmit the information of a control map including the upper limit value received from the second internal combustion engine unit to the first internal combustion engine unit using the second communicator.

7. A server device comprising:

a second communicator configured to communicate with a first communicator; and a processor configured to transmit information to a plurality of internal combustion engine units using the second communicator, each of the plurality of internal combustion engine units including an internal combustion engine, the first communicator configured to communicate with the server device, and a communication controller configured to transmit the estimation information which is used to estimate an environment in which the internal combustion engine is placed, the information of a control map which is used to control the internal combustion engine and information indicating a control result using the control map to the server device using the first communicator, wherein, the processor:

acquires identification information of the plurality of internal combustion engine units, identification information, the estimation information, the information of a control map, and the information indicating a control result using the control map is transmitted by each of the plurality of internal combustion engine units;

evaluates the control map that is transmitted by each of the plurality of internal combustion engine units, based on the information indicating a control result using the control map that is transmitted by each of the plurality of internal combustion engine units and evaluation criteria;

extracts a first internal combustion engine unit in which evaluation is not satisfied from among the plurality of internal combustion engine units; and transmits a control map that is used by a second internal combustion engine unit to the first internal combustion engine unit, the second internal combustion engine unit is different from the first internal combustion engine unit and is included in the plurality of internal combustion engine units;

the second internal combustion engine unit is an internal combustion engine unit that transmitted the control map in which evaluation is satisfied and the second internal combustion engine unit having transmitted estimation information which is similar to the estimation information received from the first internal combustion engine unit, and the first internal combustion engine unit controls the internal combustion engine using the control map that is used by a second internal combustion engine unit.

8. An internal combustion engine management method comprising:

causing a computer of an internal combustion engine unit of a plurality of internal combustion engine units to transmit estimation information which is used to estimate an environment in which an internal combustion engine is placed, information of a control map which is used to control the internal combustion engine and information indicating a control result using the control map to a server device using a first communicator configured to communicate with the server device; and causing a computer of the server device to transmit information to the plurality of internal combustion engine units using a second communicator configured to communicate with the first communicator, wherein, the computer of the server device is further caused to:

acquire identification information of the plurality of internal combustion engine units, identification information, the estimation information, the information of a control map, and the information indicating a control result using the control map is transmitted by each of the plurality of internal combustion engine units;

evaluate the control map that is transmitted by each of the plurality of internal combustion engine units, based on the information indicating a control result using the control map that is transmitted by each of the plurality of internal combustion engine units and evaluation criteria;

extract a first internal combustion engine unit in which evaluation is not satisfied from among the plurality of internal combustion engine units; and transmit a control map that is used by a second internal combustion engine unit to the first internal combustion engine unit, the second internal combustion engine unit is different from the first internal combustion engine unit and is included in the plurality of internal combustion engine units;

the second internal combustion engine unit is an internal combustion engine unit that transmitted the control map in which evaluation is satisfied and the second internal combustion engine unit having transmitted estimation information which is similar to the estimation information received from the first internal combustion engine unit, and the first internal combustion engine unit controls the internal combustion engine using the control map that is used by a second internal combustion engine unit.

9. The internal combustion engine management system according to claim 1, wherein, the processor:

further acquires position information of each of the plurality of internal combustion engine units, evaluates the control map that is transmitted by each of the plurality of internal combustion engine units, based on the information indicating a control result using the control map that is transmitted by each of the plurality of internal combustion engine units and evaluation criteria that is prescribed for each piece of the position information.

10. The internal combustion engine management system according to claim 9, wherein the evaluation criteria that is prescribed for each piece of the position information is based on environmental regulation that is prescribed for the position information or regulation of noise that is prescribed for the position information.

* * * * *